US011148318B2

(12) United States Patent
Wang

(10) Patent No.: US 11,148,318 B2
(45) Date of Patent: Oct. 19, 2021

(54) METHOD FOR MANUFACTURING RECONSTITUTED BAMBOO LUMBER FOR OUTDOOR BAMBOO FLOORING

(71) Applicant: Yuan Wang, Anji (CN)

(72) Inventor: Yuan Wang, Anji (CN)

( * ) Notice: Subject to any disclaimer, the term of this patent is extended or adjusted under 35 U.S.C. 154(b) by 424 days.

(21) Appl. No.: 15/905,673

(22) Filed: Feb. 26, 2018

(65) Prior Publication Data

US 2019/0263017 A1 Aug. 29, 2019

(51) Int. Cl.

| | |
|---|---|
| ***B27N 3/04*** | (2006.01) |
| ***B27N 3/18*** | (2006.01) |
| ***B27N 1/00*** | (2006.01) |
| ***B27N 3/00*** | (2006.01) |

(52) U.S. Cl.
CPC ..... *B27N 3/04* (2013.01); *B27N 1/00* (2013.01); *B27N 3/002* (2013.01); *B27N 3/18* (2013.01)

(58) Field of Classification Search
CPC ..... B27K 9/002
See application file for complete search history.

(56) References Cited

U.S. PATENT DOCUMENTS 5,972,467 A * 10/1999 Washo ..... B27J 1/00 144/333
8,268,430 B2 * 9/2012 Johnson ..... B27N 1/00 428/54
2007/0077444 A1 * 4/2007 Wang ..... B29C 43/003 428/532
2008/0023868 A1 * 1/2008 Slaven ..... B27N 3/18 264/109
2008/0053570 A1 * 3/2008 Wang ..... B27N 3/04 144/333
2010/0178451 A1 * 7/2010 Li ..... B27N 5/00 428/106
2011/0027529 A1 * 2/2011 Zhang ..... B27N 3/04 428/137
2011/0293885 A1 * 12/2011 Yu ..... B27N 1/00 428/136
2013/0219826 A1 * 8/2013 Kracht ..... B32B 3/08 52/796.1
2016/0208441 A1 * 7/2016 Avraham ..... E01B 3/02
2017/0114541 A1 * 4/2017 Hebel ..... E04C 5/168
2018/0361617 A1 * 12/2018 Peng ..... B27N 5/00
2019/0358849 A1 * 11/2019 Oshima ..... B27N 3/04

* cited by examiner

*Primary Examiner* — Mary Lynn F Theisen
(74) *Attorney, Agent, or Firm* — Che-Yang Chen; Law Office of Michael Chen

(57) ABSTRACT

In one aspect, a method for manufacturing outdoor bamboo flooring may include steps of: (i) cutting one or more pieces of bamboo lumbers into a predetermined length; (ii) splitting and defibering the bamboo lumbers into reticular fiber bundles; (iii) conducting a high-temperature treatment to dry the bamboo lumbers in step (ii), immersing them with glues, and then conducting a second drying; (iv) performing pressing and curing on the bamboo lumbers treated in step (iii); and (v) cutting the bamboo lumbers in step (iv) into a predetermined of pieces.

9 Claims, No Drawings

METHOD FOR MANUFACTURING RECONSTITUTED BAMBOO LUMBER FOR OUTDOOR BAMBOO FLOORING

FIELD OF THE INVENTION

The present invention relates to an artificial wood-based board, and in particular to a method of making a reconstituted bamboo lumber used for outdoor bamboo flooring.

BACKGROUND OF THE INVENTION

The use of artificial wood-based boards to replace natural boards is a positive development for the use of modern bamboo wood boards in a variety of applications due to their environmental sustainability and board performance. Boards manufactured for outdoor use need to stand up to harsh environmental conditions such as sunlight, rain, ice, snow, frost, high-temperatures and strong ultraviolet radiation, therefore the boards intended for outdoor use must meet high standards for water-swelling ratio, resistance to thermal expansion and contraction, anti-bacterial and anti-mildew properties, anti-cracking performance and durability. The present invention produces bamboo boards suitable for outdoor environments, to address these challenges.

SUMMARY OF THE INVENTION

The present invention provides high-performance reconstituted bamboo lumber for outdoor uses. The present invention provides a method of making reconstituted bamboo lumber used for outdoor bamboo flooring, comprising the following steps: (1) take the material, cut the material to required length; (2) split, defiber into reticular fiber bundles; (3) conducting high-temperature treatment, dry the treated materials, immerse them into glues, and then conduct the second drying; (4) perform pressing and curing; and (5) cut into pieces.

In one embodiment, the raw material taken from step (1) is raw bamboo of more than two years' growth, and the cutting of the bamboo segments at the required length should avoid the bamboo joints. The strength and toughness of raw bamboo fiber filaments from bamboo that has grown for more than two years can meet the requirements for defibering, and the strength and other key performance qualities of the final product are achieved by the raw bamboo fiber filaments. Therefore, bamboo used in this process must be raw bamboo that has grown for more than two years.

In another embodiment, the defibration process described in step (2) is to place split bamboo strips into a teeth-engaged defiberer and the defiberer compresses the bamboo strips to physically decompose bamboo fibers into fiber bundles. The fiber bundles present a reticular structure due to this compression and distortion. After being defibered by a teeth-engaged defiberer, raw bamboo strips form small fiber bundles like sugar cane bagasse left after eating. Due to the engagement, some fibers in the fiber bundles will become twisted, and finally the fiber bundles present a reticular structure.

In yet another embodiment, the high-temperature treatment in step (3) is high-pressure steam cooking, and the high-pressure steam pressure is 0.1 to 0.6 mPa, the time of high-pressure steam cooking is 0.5 to 6 hours, and the drying effect is that the moisture content of fiber bundles is 15% or less. The drying methods may be drying by a dryer or drying under sunshine or air-drying. Cooking under high temperature and high pressure destroys the sugars and other nutrients originally contained in bamboo fibers, reduces the possibility of mildewing, and its color is closer to natural wood; in addition, it improves the life-span of the boards. The purpose of drying is to prepare the material for treatment in the next step.

More specifically, the high-temperature treatment in step (3) is high-temperature carbonization of fiber bundles in carbonization equipment post-drying. The temperature of high-temperature carbonization is between 150° C. and 250° C., and the time is 6 to 15 hours. The purpose of carbonization is to remove sugars and other nutrients, and reduce the activity of bamboo fibers.

Moreover, the glue immersion process in step (3) makes all small units of bamboo fiber bundles fully absorb the glue. The glue solid content in the bamboo fiber bundles after immersion can reach 5% to 20%, and for the second drying, the average water content of the bamboo fiber bundles immersed with glue drops to less than 20%. When the glue solid content is between 5% and 20%, it can guarantee the performance indexes of strength and water-swelling ratio, without significantly increasing costs. The glue-containing bamboo fiber bundles after second drying should be set aside for more than 24 hours until the moisture is even, to prevent the occurrence of internal stress, shrinkage cracks and color deviation that can result from uneven moisture in the finished products.

In one embodiment, the glue used in step (3) is a water-soluble phenol glue generated by the reaction of a formaldehyde solution with phenol in an alkaline environment, and the formaldehyde solution is a solution of formaldehyde containing 0.5% to 15% methanol. Then the water-soluble phenol glue prepared is modified with resorcinol, or modified with organic silicone, or modified with polyethylene, or modified with nano-silicon or modified with melamine, with the ratio of modifier at 0.5% to 10%. The prepared glue is the glue used for immersion in step (3) in the present invention. The use of modified glue can shorten the heating and curing time, increase the bonding strength and improve waterproof and crack resistance performance.

For the hot pressing and curing described in step (4), the glued bamboo fiber bundles after pretreatment are placed to a mold, and the mold volume is established according to the density of 1.1 to 1.5 g/cm$^3$, and then delivered to a hot pressing machine, to undergo hot pressing and curing by controlling the board surface contact pressure at 5 to 15 MPa. The hot pressing temperature is between 120° C. and 160° C., the curing time is 1.1 to 1.6 min/mm. After curing, the boards are cooled until the board core temperature is below 80° C. The mold is then ready for assembling. The assembling process is to place all fiber bundles in the mold by layers according to longitudinal or crisscross directions. The finished board temperature is less than 80° C. of the board center, which ensures that there will be no bulging, no blistering nor deformation of the boards. Before the cutting in step (5), and after hot pressing, the boards should be stored for more than three days to release internal stress, and only then are they cut.

In one embodiment, the pressing in step (4) is cold pressing, which involves first placing the glued bamboo fibers into a mold, then securing them with lock pins after pressing, and then placing them with the mold into a heating device for heating. The use of cold pressing instead of hot pressing can make the board density and moisture more uniform and colors more consistent.

The present invention is advantageous because it can minimize the costs of reconstituted bamboo lumber while standing up to the harsh conditions of outdoor use, thereby achieving the purposes of the invention, with extremely high economic value.

DETAILED DESCRIPTION OF THE EMBODIMENTS

The detailed description set forth below is intended as a description of the present exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

The present invention is further described in with the following examples:

Example 1

In one aspect, a method of making reconstituted bamboo lumber used for outdoor bamboo flooring, comprising the steps of (1) select the material, cut into the required length; (2) split, defiber into reticular fiber bundles; (3) conduct high-temperature treatment, dry the treated materials and immerse into glues, and then conduct the second drying; (4) perform pressing and curing; and (5) cut into pieces.

In one embodiment, the raw material taken from step (1) is raw bamboo of more than two years' growth, and the cutting of the bamboo segments at the required length should avoid the bamboo joint. The defibration process described in step (2) is to place split bamboo strips into a teeth-engaged defiberer and the defiberer compresses the bamboo to physically decompose bamboo fibers into fiber bundles. The fiber bundles present a reticular structure due to the compression and distortion.

In another embodiment, the high-temperature treatment in step (3) is high-pressure steam cooking, and the high-pressure steam pressure is 0.1~0.6 mPa, the time of high-pressure steam cooking is 0.5 to 6 hours, and the drying effect is that the moisture content of fiber bundles is 15% or less. The drying methods may be drying by a dryer or drying under sunshine or air-drying. The glue immersion process in step (3) is to make all small units of bamboo fiber bundles to fully absorb the glue. The glue solid content in the bamboo fiber bundles after immersion can reach 5% to 20%, and for the second drying, the average water content of the bamboo fiber bundles immersed with glue drops to less than 20%. The glue-containing bamboo fiber bundles after second drying should be set aside for more than 24 hours until the moisture is even. In still another embodiment, the glue used in step (3) is a water-soluble phenol glue generated by the reaction of a formaldehyde solution with phenol in an alkaline environment, and the formaldehyde solution is a solution of formaldehyde containing 0.5% to 15% methanol. Then the water-soluble phenol glue prepared is modified with resorcinol, or modified with organic silicone, or modified with polyethylene, or modified with nano-silicon or modified with melamine, with the ratio of modifier at 0.5%~10%. The prepared glue is the glue used for immersion in step (3) in the present invention.

For the hot pressing and curing described in step (4), the glued bamboo fiber bundles after pretreatment are placed to a mold, and the mold volume is established according to the density of 1.1 to 1.5 g/cm$^3$, and then delivered to a hot pressing machine, to perform hot pressing and curing by controlling the board surface contact pressure at 5 to 15 MPa. The hot pressing temperature is between 120° C. and 160° C., the curing time is 1.1 to 1.6 min/mm. After curing, the boards are cooled down until the board core temperature is below 80° C. The mold is then ready for assembling, and the assembling process is to place all fiber bundles to the mold by layers according to longitudinal or crisscross direction. Before the cutting in step (5), and after the boards have been hot pressed, the boards should be stored for more than three days to release internal stress, and then cut.

Example 2

A method of making reconstituted bamboo lumber used for outdoor bamboo flooring, comprising the steps of (1) select the material, cut into the required length; (2) split, defiber into reticular fiber bundles; (3) conduct high-temperature treatment, dry the treated materials and immerse into glues, and then conduct the second drying; (4) perform pressing and curing; and (5) cut into pieces.

In one embodiment, the raw material taken from step (1) is raw bamboo of more than two years' growth, and the cutting of the bamboo segments at the required length should avoid the bamboo joint. The defibration process described in step (2) is to place split bamboo strips into a teeth-engaged defiberer and the defiberer compresses the bamboo to physically decompose bamboo fibers into fiber bundles. The fiber bundles present a reticular structure due to the compression and distortion.

In another embodiment, the high-temperature treatment in step (3) is high-temperature carbonization of fiber bundles in a carbonization equipment after drying. The temperature of high-temperature carbonization is between 150° C. and 250° C., and the time is 6 to 15 hours. The glue immersion process in step (3) is to make all small units of bamboo fiber bundles to fully absorb the glue. The glue solid content in the bamboo fiber bundles after immersion can reach 5%~20%, and for the second drying, the average water content of the bamboo fiber bundles immersed with glue drops to less than 20%. The glue-containing bamboo fiber bundles after second drying should be set aside for more than 24 hours until the moisture is even. More specifically, the glue used in step (3) is a water-soluble phenol glue generated by the reaction of a formaldehyde solution with phenol in an alkaline environment, and the formaldehyde solution is solution of formaldehyde containing 0.5% to 15% methanol. Then the water-soluble phenol glue prepared is modified with resorcinol, or modified with organic silicone, or modified with polyethylene, or modified with nano-silicon or modified with melamine, with the ratio of modifier at 0.5% to 10%. The prepared glue is the glue used for immersion in step (3) in the present invention.

For the hot pressing and curing described in step (4), the glued bamboo fiber bundles after pretreatment are placed to a mold, and the mold volume is established according to the density of 1.1 to 1.5 g/cm$^3$, and then delivered to a hot pressing machine, to perform hot pressing and curing by controlling the board surface contact pressure at 5 to 15 MPa. The hot pressing temperature is between 120° C. and 160° C., the curing time is 1.1 to 1.6 min/mm; after curing, cool down until the board core temperature is below 80° C. before taking out the boards. The mold is ready to be assembled, and the assembling is to place all fiber bundles to the mold by layers according to longitudinal or crisscross direction. Before the cutting in step (5), the boards after hot pressing should be stored for more than three days to release internal stress, and then cut.

Example 3

In a further aspect, a method of making reconstituted bamboo lumber used for outdoor bamboo flooring, comprising the steps of (1) select the material, cut into the required length; (2) split, defiber into reticular fiber bundles; (3) conduct high-temperature treatment, dry the treated materials and immerse into glues, and then conduct the second drying; (4) perform pressing and curing; and (5) cut into pieces.

In one embodiment, the raw material taken from step (1) is raw bamboo of more than two years' growth, and the cutting of the bamboo segments at the required length should avoid the bamboo joint. The defibration process described in step (2) is to place split bamboo strips into a teeth-engaged defiberer and the defiberer compresses the bamboo to physically decompose bamboo fibers into fiber bundles. The fiber bundles present a reticular structure due to the compression and distortion.

In another embodiment, the glue immersion process in the step (3) is to make all small units of bamboo fiber bundles to fully absorb the glue. The glue solid content in the bamboo fiber bundles after immersion can reach 5% to 20%, and for the second drying, the average water content of the bamboo fiber bundles immersed with glue drops to less than 20%. The glue-containing bamboo fiber bundles after second drying should be set aside for more than 24 hours until the moisture is even. The pressing is cold pressing, the cold pressing is to place the glued bamboo fibers in a mold firstly, then lock them by lock pins after pressing, and then place them with the mold to a heating device for heating. Before the cutting in step (5), the boards after hot pressing should be stored for more than three days to release internal stress, and then cut.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A method for manufacturing outdoor bamboo flooring comprising steps of: (i) cutting one or more pieces of bamboo lumbers into a predetermined length; (ii) splitting and defibering the bamboo lumbers into reticular fiber bundles; (iii) conducting a high-temperature treatment to dry the bamboo lumbers in step (ii), immersing them with glues, and then conducting a second drying; (iv) performing pressing and curing on the bamboo lumbers treated in step (iii); and (v) cutting the bamboo lumbers in step (iv) into a predetermined number of pieces, wherein the step of conducting a high-temperature treatment further includes a high-temperature carbonization of fiber bundles in a carbonization equipment after drying, the temperature of high-temperature carbonization is between 150° C. and 250° C., and the time is 6 to 15 hours.

2. The method for manufacturing outdoor bamboo flooring of claim 1, wherein the bamboo lumber in step (i) is raw bamboo of more than two years' growth, and cutting of the bamboo lumber should avoid bamboo joints.

3. The method for manufacturing outdoor bamboo flooring of claim 1, wherein the step of defibering the bamboo lumbers further includes steps of placing split bamboo lumbers into a teeth-engaged defiberer to physically decompose bamboo fibers of the bamboo lumbers into fiber bundles with reticular structure.

4. The method for manufacturing outdoor bamboo flooring of claim 1, wherein the step of conducting a high-temperature treatment further includes steps of a high-pressure steam cooking, and the high-pressure steam pressure is 0.1~0.6 mPa, the time of high-pressure steam cooking is 0.5~6 hours, and the drying effect is that the moisture content of fiber bundles is 15% or less, the drying methods may be drying by a dryer or drying under sunshine or air-drying.

5. The method for manufacturing outdoor bamboo flooring of claim 1, wherein the glue immersion step further includes steps of immersing the bamboo fiber bundles to fully absorb the glue; the glue solid content in the bamboo fiber bundles after immersion can reach 5% to 20%, and for the second drying, the average water content of the bamboo fiber bundles immersed with glue drops to less than 20%.

6. The method for manufacturing outdoor bamboo flooring of claim 1, wherein the glue used in step (iii) is a water-soluble phenol glue generated by the reaction of a formaldehyde solution with phenol in an alkaline environment, and the formaldehyde solution is solution of formaldehyde containing 0.5% to 15% methanol, then the water-soluble phenol glue prepared is modified with resorcinol, or modified with organic silicone, or modified with polyethylene, or modified with nano-silicon or modified with melamine, with the ratio of modifier at 0.5% to 10%.

7. The method for manufacturing outdoor bamboo flooring of claim 1, wherein the step of pressing and curing described in step (iv) further includes steps of placing the glued bamboo fiber bundles after pretreatment into a mold; the mold volume is established according to the density of 1.1 to 1.5 g/cm$^3$, delivering the mold to a hot pressing machine to perform hot pressing and curing by controlling the board surface contact pressure at 5~15 MPa; the hot pressing temperature is between 120° C. and 160° C., the curing time is 1.1 to 1.6 min/mm, and after curing, cooling the mold down until the board core temperature is below 80° C.

8. The method for manufacturing outdoor bamboo flooring of claim a, wherein before the cutting in step (v), the bamboo lumbers treated in step (iv) after hot pressing should be stored for more than three days to release internal stress, and then cut.

9. The method for manufacturing outdoor bamboo flooring of claim 1, wherein the pressing is cold pressing, the cold pressing is to place the glued bamboo fibers in a mold firstly, then securing them by lock pins after pressing, and then place them with the mold to a heating device for heating and curing, and perform demolding after fully curing and cooling.

* * * * *